US007344038B2

(12) United States Patent
Elansary

(10) Patent No.: US 7,344,038 B2
(45) Date of Patent: Mar. 18, 2008

(54) INSULATED CONTAINER FOR LIQUIDS

(76) Inventor: Mohamed Elansary, 164 E. Marshall Rd., Lansdowne, PA (US) 19050

( * ) Notice: Subject to any disclaimer, the term of this patent is extended or adjusted under 35 U.S.C. 154(b) by 159 days.

(21) Appl. No.: 10/864,179

(22) Filed: Jun. 9, 2004

(65) Prior Publication Data

US 2005/0274686 A1 Dec. 15, 2005

(51) Int. Cl.
*B65D 23/08* (2006.01)

(52) U.S. Cl. ..... 215/12.1; 215/13.1; 220/739; 220/903

(58) Field of Classification Search ..... 215/12.1, 215/12.2, 13.1; 220/592.05, 592.16, 592.2, 220/592.25, 62.18, 739, 737, 903; 229/403; 150/901

See application file for complete search history.

(56) References Cited

U.S. PATENT DOCUMENTS 549,394 A * 11/1895 Presnell ..... 215/11.6
2,028,566 A * 1/1936 Seipel et al. ..... 294/31.2
2,266,828 A * 12/1941 Sykes ..... 220/1.5
2,729,259 A * 1/1956 Abrams ..... 215/12.1
3,220,595 A * 11/1965 Edwards ..... 206/519
3,443,715 A * 5/1969 Edwards ..... 220/671
3,661,288 A * 5/1972 Noll ..... 215/11.1
4,510,769 A 4/1985 McClellan, Jr. ..... 62/457
4,705,085 A * 11/1987 Brown ..... 220/592.16
4,708,254 A 11/1987 Byrns ..... 215/13.1
4,993,580 A * 2/1991 Smith ..... 220/1.5
5,205,473 A * 4/1993 Coffin, Sr. ..... 229/403
5,277,324 A 1/1994 Cash ..... 215/100.5
5,303,840 A * 4/1994 Sharp ..... 220/62.18
5,494,198 A 2/1996 Heiberger ..... 222/183
5,529,217 A 6/1996 Siegel ..... 222/131
5,586,681 A 12/1996 Policappelli ..... 220/674
5,762,230 A 6/1998 Policappelli ..... 220/461
5,765,716 A * 6/1998 Cai et al. ..... 220/740
5,794,843 A 8/1998 Sanchez ..... 229/403
5,820,016 A * 10/1998 Stropkay ..... 229/403
5,845,806 A * 12/1998 Parchman ..... 220/739
5,901,882 A 5/1999 Siegel ..... 222/131
5,960,975 A 10/1999 Lennartsson ..... 220/62.22
5,960,998 A * 10/1999 Brown ..... 222/131
6,041,952 A 3/2000 Martin ..... 215/12.1
6,164,469 A 12/2000 Sartore ..... 215/12.1
6,224,954 B1 * 5/2001 Mitchell et al. ..... 428/34.2
6,253,995 B1 * 7/2001 Blok et al. ..... 229/403
6,308,846 B1 10/2001 Müller ..... 215/13.1
6,729,534 B2 * 5/2004 Van Handel ..... 229/403
2002/0020687 A1 2/2002 Sasaki et al. ..... 215/384
2003/0075549 A1 * 4/2003 O'Brien et al. ..... 220/739

FOREIGN PATENT DOCUMENTS

FR 2476606 * 8/1981
FR 2 618 756 - A 1 7/1987

* cited by examiner

*Primary Examiner*—Sue A. Weaver
(74) *Attorney, Agent, or Firm*—Robert S. Lipton, Esq.; Lipton, Weinberger & Husick

(57) ABSTRACT

The Invention is a container for holding a liquid, such as a single-use beverage bottle. Gas-filled annular rings appear on a portion of the surface of the bottle. The air-filled annular rings partially insulate the bottle and slow the rate of heat transfer to and from the contents of the bottle. The air-filled annular rings also serve to provide a gripping surface to aid in the handling to the bottle by a user.

6 Claims, 7 Drawing Sheets

INSULATED CONTAINER FOR LIQUIDS

FIELD OF THE INVENTION

The Invention is an insulated container for holding a liquid. Insulation is provided by air-filled annular rings surrounding a portion of the container. The annular rings are formed during the manufacture of the container and are incorporated into the structure of the container. A suitable application for the Invention is as a single-use beverage bottle.

BACKGROUND OF THE INVENTION

It is desirable to control the rate of transfer of heat across the walls of a bottle or other container to control the rate at which a chilled liquid is warmed by ambient air outside the container and to control the rate at which a heated liquid in the container is cooled.

SUMMARY OF THE INVENTION

The present invention is a single-use container for holding a liquid, such as a disposable bottle for a consumer beverage. The container has a wall and is composed of a suitable material, such as a plastic. A surround member engages the wall of the container. One or more annular rings are defined by the surround member. Each annular ring in combination with the wall of the container defines an interior volume that contains air or other gas. The air or other gas contained in the interior volume of the annular ring acts to slow the transfer of heat to and from the interior of the container. An annular reinforcing member separates and supports the wall of the container and the corresponding annular ring. The number and location of the annular rings is selected to achieve a desired overall rate of heat transfer across the wall of the container.

The annular rings may be formed by the wall of the container and the surround member in combination, as described above. Alternatively, separately-formed gas-filled annular rings may be added to a container, either individually or as an array of annular rings. The annular rings also may serve the purpose of providing an improved gripping surface to help a user to retain the container in his or her hand. As used in this application, the term 'gas' includes air.

BRIEF DESCRIPTION OF THE DRAWINGS

The accompanying drawings, which are incorporated in and form a part of the specification, illustrate the embodiments of the present invention and, together with the description, serve to explain the principles of the invention.

DETAILED DESCRIPTION OF AN EMBODIMENT

In describing an embodiment of the invention, specific terminology will be selected for the sake of clarity. However, the invention is not intended to be limited to the specific terms so selected, and it is to be understood that each specific term includes all technical equivalents that operate in a similar manner to accomplish a similar purpose.

Figure 1:
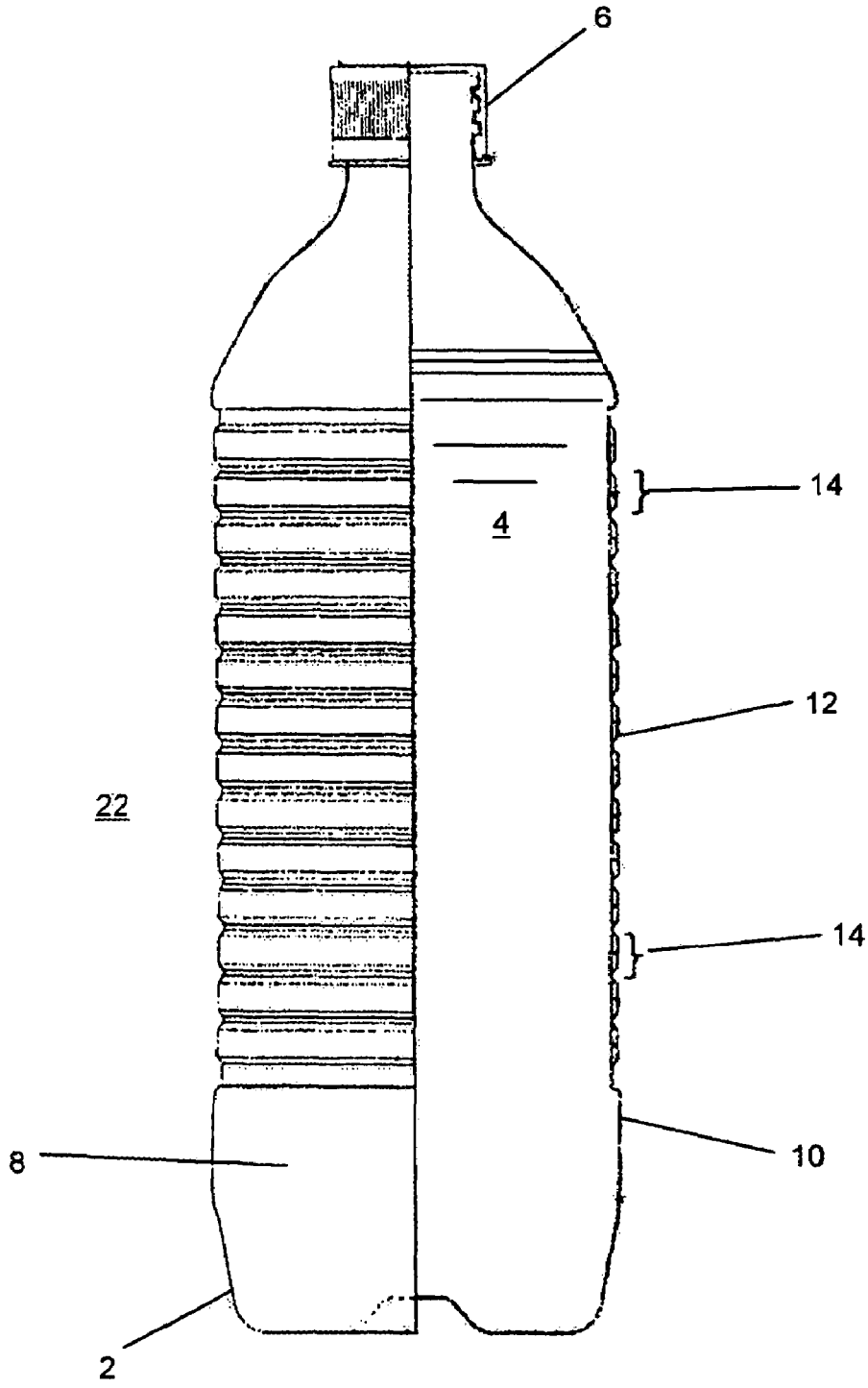
FIG. 1 is a cutaway side view of the first embodiment of the Invention.

Referring to FIG. 1, a container 2 holds a liquid 4. Container 2 is sealed with a conventional removable cap 6. Container 2 is composed of a transparent or translucent plastic or other suitable material. Container 2 has a wall 8 that has an outer surface 10. Surround member 12 engages outer surface 10 of wall 8. Surround member 12 defines a plurality of annular rings 14.

Figure 2:
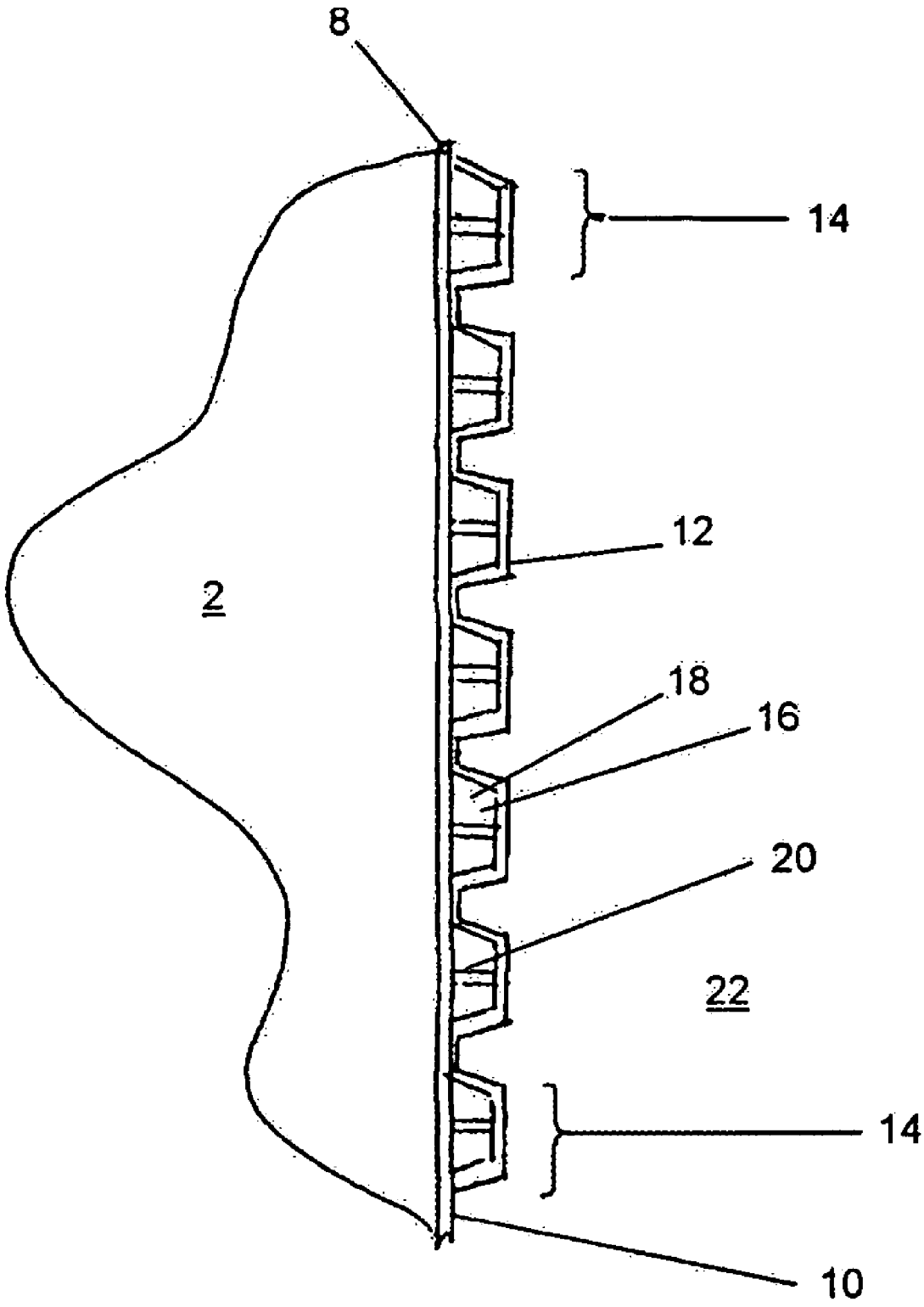
FIG. 2 is a detail cross section of the first embodiment.

Referring to FIG. 2, each annular ring 14 defines an interior volume 16. Each interior volume 16 is filled with air or with another suitable gas 18. An annular reinforcing member 20 engages the outer surface 10 of wall 8 and also engages surround member 12. Annular reinforcing member 20 serves to reinforce annular ring 14 and to prevent annular ring 14 from collapsing during handling of container 2.

Decisions made in the design of a specific application of the Invention may render use of the annular reinforcing member 20 unnecessary, such as selecting a material for the surround member 12 or dimensions of the surround member 12 sufficient to maintain a pre-selected shape of annular ring 14.

Figure 3:
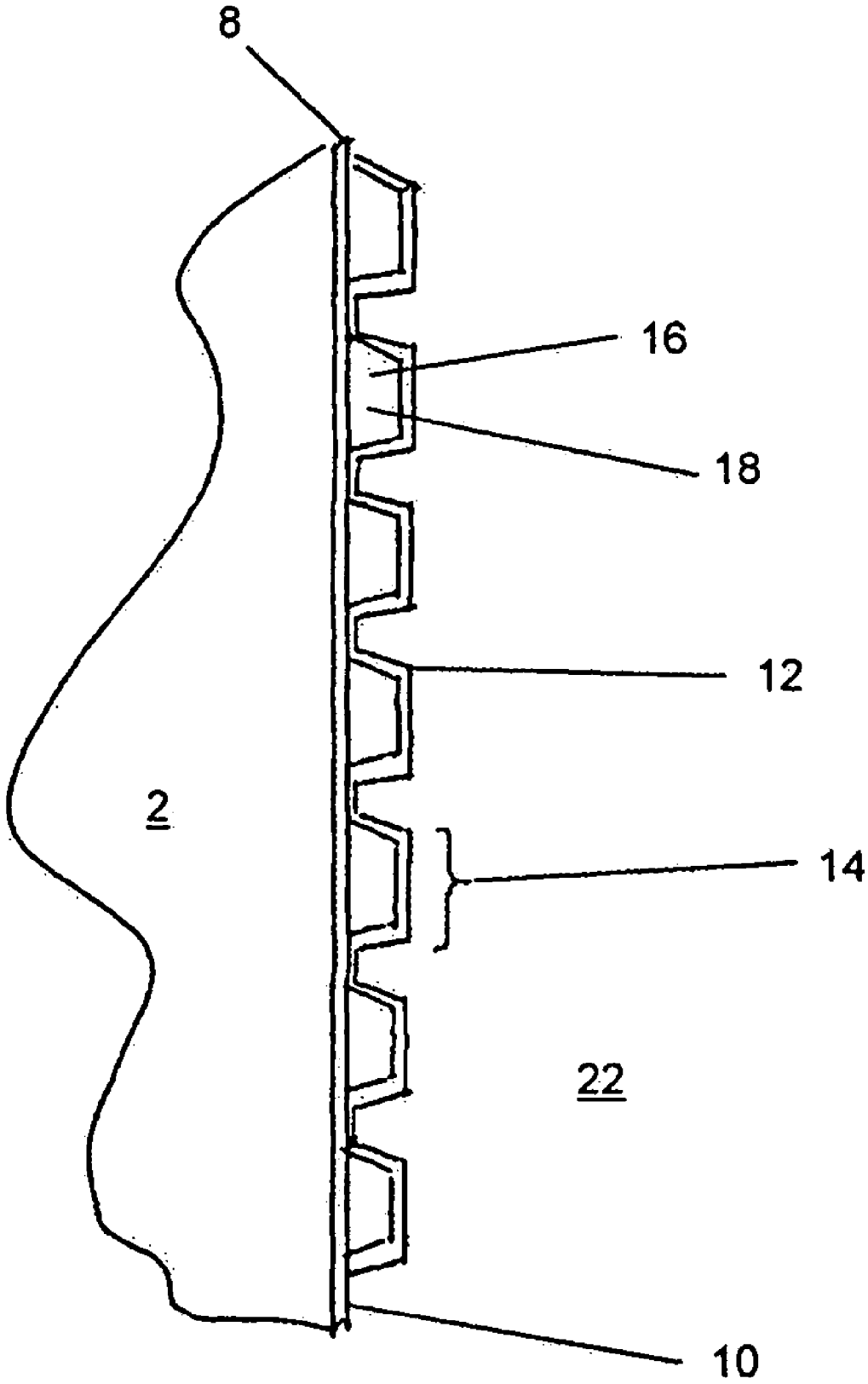
FIG. 3 is a second detail cross section of the first embodiment.

FIG. 3 illustrates an application dispensing with the reinforcing member 20. Surround member 12 engages wall 8 outer surface 10 of container 2. A plurality of annular rings 14 are defined by surround member 12. Each annular ring in combination with the outer surface 10 of wall 8 defines an interior volume 16. In the application of FIG. 3, a surround member 12 is composed of a material that is adequately stiff to maintain the shape of annular ring 14 during ordinary handling of container 2.

For each of the embodiments, each interior volume 16 is filled with air or other suitable gas 18. The gas 18 may be vented to the ambient air 22 (and hence at ambient pressure) or may be sealed and under a pressure higher than ambient. Annular reinforcing member 20 may be dispensed with if a pressure for gas 18 is selected sufficiently above ambient pressure to maintain the pre-selected shape of annular ring 14.

The plurality of interior volumes 16, each containing air or other suitable gas 18, serve to retard the rate of heat transfer between the liquid 4 held in the container 2 and the ambient air 22 outside of the container. The annular rings 14 also serve to provide an improved gripping surface for a person using the container 2. The number, location and dimensions of annular rings 14 are selected during design of a particular application of the Invention to achieve a desired overall thermal conductivity between the ambient air 22 and the liquid held in the container 2. As used in this application, the term "configure" or "configuration" means the number, location, dimensions and composition of the annular rings 14. The term "overall" with respect to thermal conductivity refers to the transfer of heat by conduction or convection from the ambient air 22 to or from the liquid 4 for the entire bottle, including those portions of the bottle 2 not covered by the surround member 12

Figure 4:
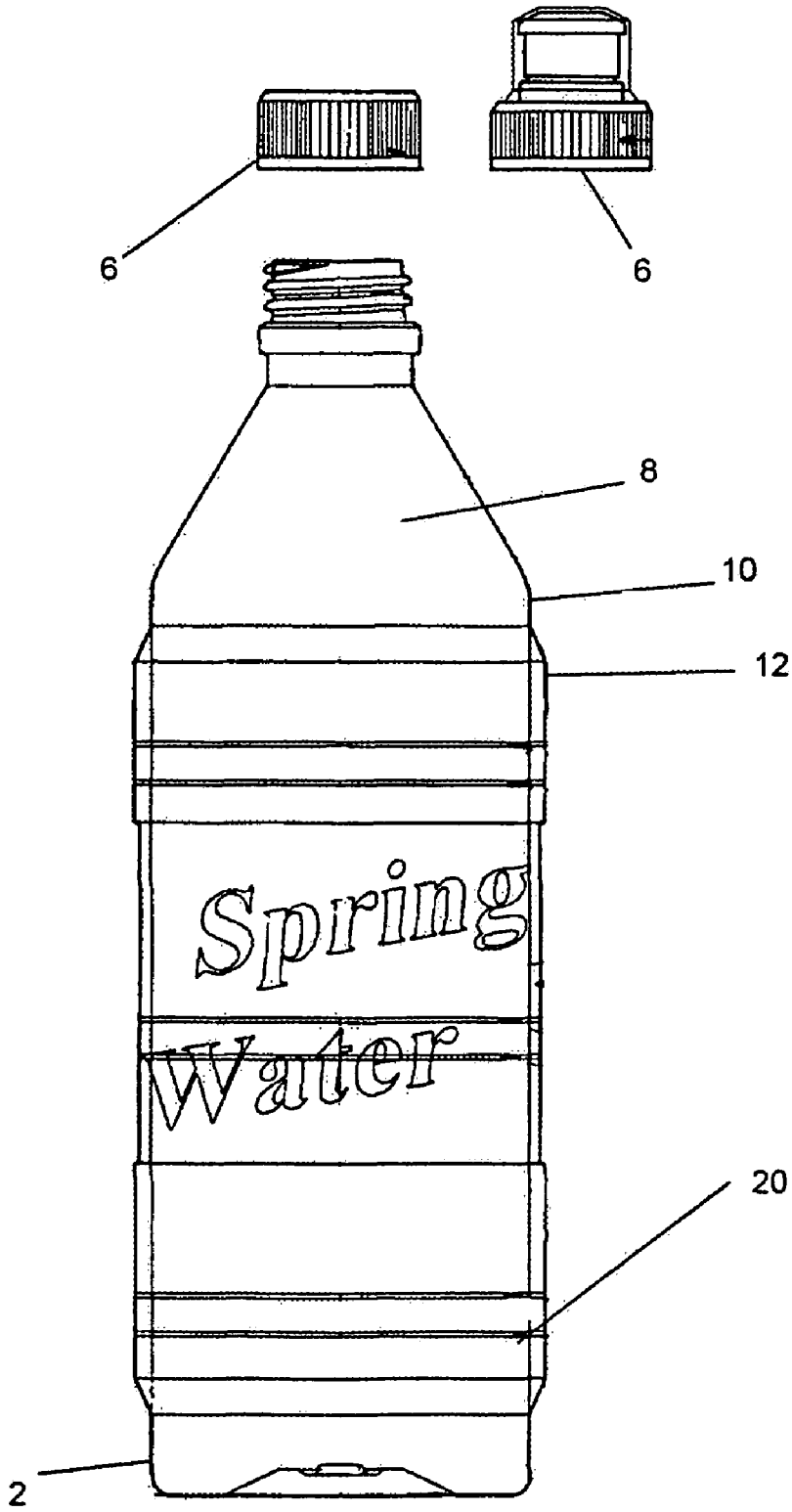
FIG. 4 is a side view of a second embodiment
Figure 5:
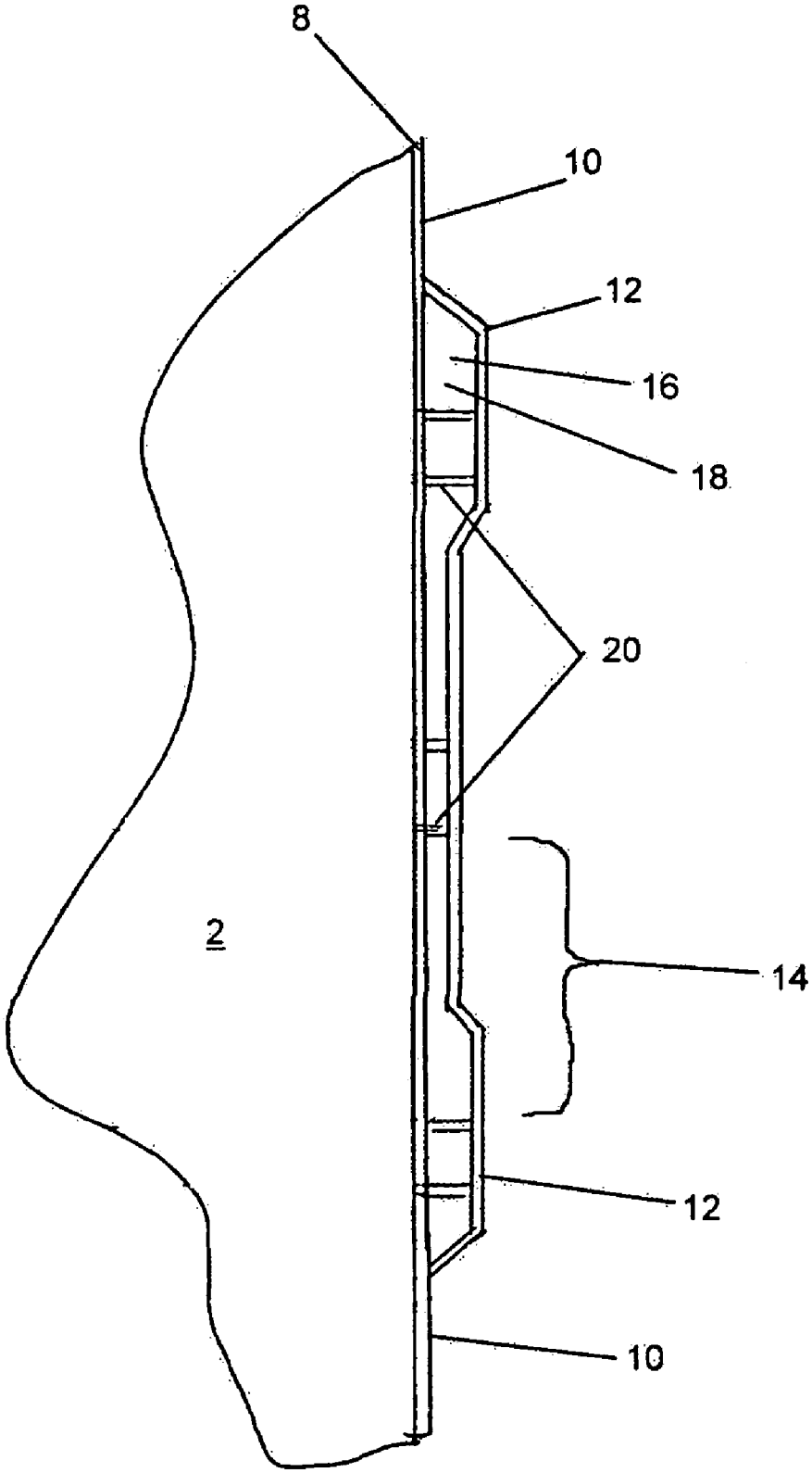
FIG. 5 is a detail cross section of the second embodiment.

FIGS. 4 and 5 illustrate an alternative embodiment. In the side view of FIG. 4 and the detail cross section of FIG. 5, container 2 has wall 8 and wall outer surface 10. Surround member 12 engages wall outer surface 10. In this embodiment, surround member 12 in combination with annular reinforcing members 20 define a plurality of annular rings 14. The plurality of annular rings 14, in combination with wall outer surface 10, define a plurality of interior volumes 16, each of which is filled with air or other suitable gas 18.

For any of the embodiments illustrated by FIGS. 1-5, the annular reinforcing members 20 may be molded as a part of the surround member 12. Alternatively, the reinforcing member 20 may be formed as a part of the outer surface 10 of wall 8 or may be formed separately from wall 8 or surround member 12.

Container 2 preferably is a single-use plastic bottle for a consumer beverage. The wall 8 of container 2 is preferably formed of a transparent or translucent material, such as a plastic. The surround member 12 preferably is formed from a transparent or translucent material of a color contrasting to that of the wall 8. For example, the wall 8 may be transparent and without coloration, while the surround member 12 has a blue tint.

Figure 6:
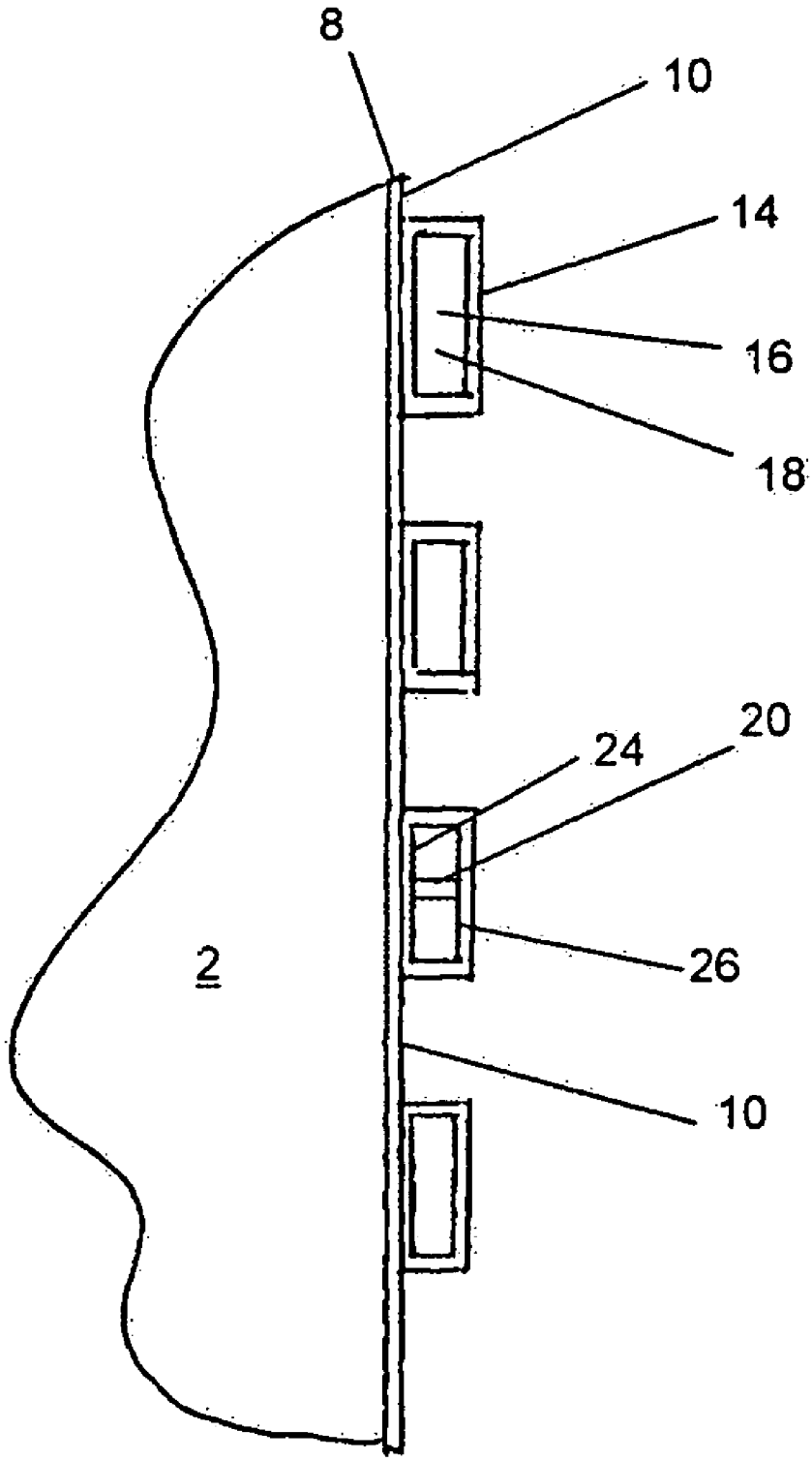
FIG. 6 is a detail cross section view of a third embodiment.

FIG. 6, a detail cross section, illustrates another embodiment. Each annular ring 14 is separately formed and the annular ring by itself defines interior volume 16. Each interior volume 16 is filled with air or other suitable gas 18. Each of a plurality of annular rings 14 is placed in a spaced separation on the outer surface 10 of container 2. The configuration of annular rings 14 is selected to accomplish the desired degree of insulation of the container 2. Annular reinforcing member 20 may engage an inner annular ring wall 24 and an outer annular ring wall 26, strengthening annular ring 14 and allowing annular ring 14 to resist deformation during handling of container 2.

Figure 7:
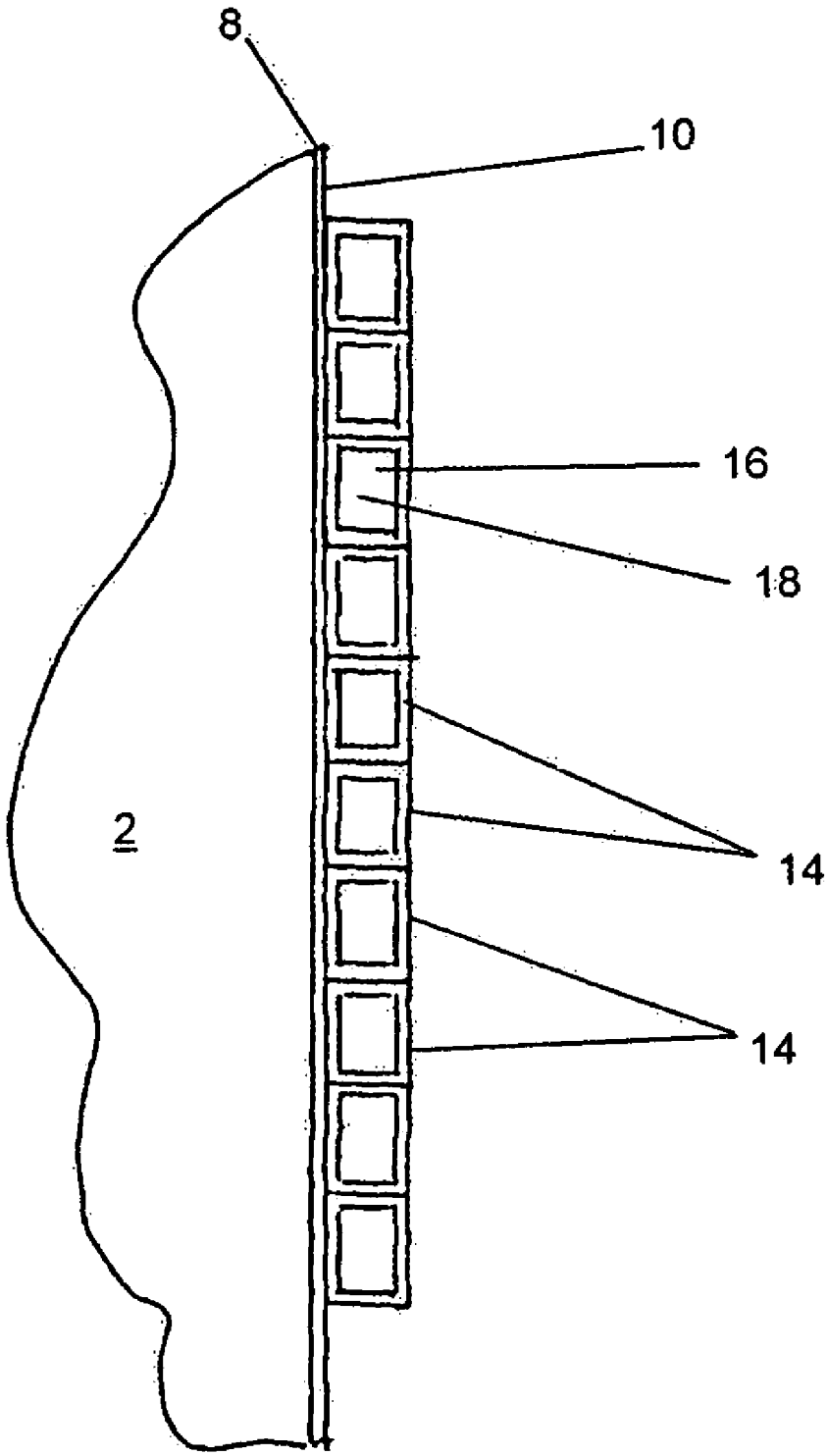
FIG. 7 is a second detail cross section view of the third embodiment.

As shown by the detail cross section of FIG. 7, the annular rings 14 of the embodiment illustrated by FIG. 6 may be placed on outer surface 10 of wall 8 of container 2 so that each of the plurality of annular rings 14 engages at least one other annular ring 14.

Although this invention has been described and illustrated by reference to specific embodiments, it will be apparent to those skilled in the art that various changes and modifications may be made which clearly fall within the scope of this invention. The present invention is intended to be protected broadly within the spirit and scope of the appended claims.

What is claimed is:

1. A single-use beverage bottle, the bottle comprising:

a. a container adapted to hold the beverage, said container having a wall, said wall having a wall outer surface;

b. a plurality of annular rings, said plurality of annular rings engaging said wall outer surface;

c. a plurality of annular reinforcing members, each of said annular reinforcing members engaging said wall outer surface and one of said annular rings, each of said annular reinforcing members being adapted to resist deformation of one of said annular rings during handling of said container;

d. a plurality of interior volumes, each of said plurality of said interior volumes being defined by one of said annular rings and said wall outer surface;

e. a gas filling each of said interior volumes, each of said interior volumes being sealed such that said gas is confined within said each of said interior volumes, said gas having a pressure, each of said annular rings having a preselected shape, said pressure being selected to be sufficiently greater than an ambient air pressure such that each said annular ring substantially maintains said pre-selected shape during handling of the single-use beverage bottle.

2. The single-use bottle of claim 1 wherein said wall outer surface defines each of said reinforcing members.

3. The single-use bottle of claim 1 wherein each of said annular rings defines at least one of said reinforcing members.

4. The single-use bottle of claim 3 wherein said wall outer surface, said plurality of said annular rings and said plurality of said annular reinforcing members in combination define said plurality of interior volumes.

5. The single-use bottle of claim 2, further comprising: a surround member, said surround member defining each of said plurality of said annular rings, said surround member engaging said wall outer surface, said surround member further defining each of said plurality of said annular reinforcing members, each of said plurality of said annular reinforcing members engaging said wall outer surface.

6. An apparatus for holding a liquid, the apparatus comprising:

a. a plurality of annular rings, each of said plurality of annular rings defining a one of a plurality of interior volumes, each said interior volume containing a gas;

b. a container, said container adapted to contain the liquid, said container having a wall, said wall defining a wall outer surface, said wall outer surface adapted to receive each of said plurality of annular rings, each of said plurality of annular rings engaging said wall outer surface, wherein each of said annular rings has a pre-selected shape, said gas contained in each of said plurality of interior volumes of said annular rings has a pressure, said pressure is selected to be sufficiently greater than an ambient air pressure such that said annular ring maintains said pre-selected shape during handling of the apparatus.

* * * * *